United States Patent [19]

Fisher et al.

[11] 4,034,491

[45] July 12, 1977

[54] MODEL BLIMP

[75] Inventors: David R. Fisher, Rancho Palos Verdes; Don C. Willis, Garden Grove; Frederick W. John; James R. Powers, both of Los Angeles; James M. Doyle, Encino; Lonnie D. Cooper, Hawthorne; Dennis C. Rich, Los Angeles, all of Calif.

[73] Assignee: Revell, Incorporated, Venice, Calif.

[21] Appl. No.: 619,228

[22] Filed: Oct. 3, 1975

[51] Int. Cl.[2] ..... G09F 11/23

[52] U.S. Cl. ..... 40/33; 40/106.52; 40/133 A

[58] Field of Search ..... 40/33, 77, 133 A, 106.52, 40/106.53, 106.54, 32, 96, 52, 53, 126 B, 28 C; 46/74 R, 76 R

[56] References Cited

U.S. PATENT DOCUMENTS

| | | | |
|---|---|---|---|
| 1,444,339 | 2/1923 | Faulkner | 40/33 |
| 1,837,894 | 12/1931 | Bosche | 40/133 A |
| 2,052,288 | 8/1936 | Grady | 40/32 X |
| 2,645,047 | 7/1953 | O'Gorman | 40/32 |
| 2,847,782 | 8/1958 | Muse | 40/32 X |
| 2,867,050 | 1/1959 | Westfall | 40/32 |

*Primary Examiner*—John F. Pitrelli

[57] ABSTRACT

A display device such as a model of a blimp has an aperture formed on one side thereof for display of information carried on a screen within the blimp. Means are provided to rotate the screen and to illuminate the screen interior so as to sequentially display the information through the aperture.

6 Claims, 9 Drawing Figures

MODEL BLIMP

BACKGROUND OF THE INVENTION

1. Field of the Invention

This invention relates to the moving display of information contained within a device at a side thereof.

2. Description of the Prior Art

For many years, the use of full-sized blimps as devices for displaying information, including advertising, has been well known. Such blimps travel throughout the United States and appear at various events, such as football games, during the daylight hours and, during darkness, are utilized to provide illuminated displays on the blimp sides. The displays generally contain advertising or other information of interest to the public viewing the blimp from the ground. Typically, such displays move along the side of the blimp and are accomplished by various types of automated programming to control the selective illumination of lights fixed to the side of the blimp.

SUMMARY OF THE INVENTION

According to the present invention, a miniaturized model of a blimp provides an illuminated display along a side thereof by utilizing a masking screen and an information carrying screen and from a source of illumination within the blimp to display information which is viewed through an aperture in the blimp outer surface so as to provide a message to a viewer. In the preferred embodiment, means are provided for initiating relative movement between the masking screen and information bearing screen so as to provide a cyclical display of the message. The masking screen has a given pattern of transparency and the information bearing screen has a selected pattern of transparency with transparent portions of increased opacity to provide for the message to be displayed. Further, in the preferred embodiment, in order to provide the illusion of movement of the message in a direction generally perpendicular to the direction of relative movement, the masking screen and information bearing screen are aligned so that the transparency patterns are slightly skewed, one with respect to the other, during the relative movement.

BRIEF DESCRIPTION OF THE DRAWING

The present invention may be more readily understood by referring to the accompanying drawing, in which.

DESCRIPTION OF THE PREFERRED EMBODIMENT

Figure 1:
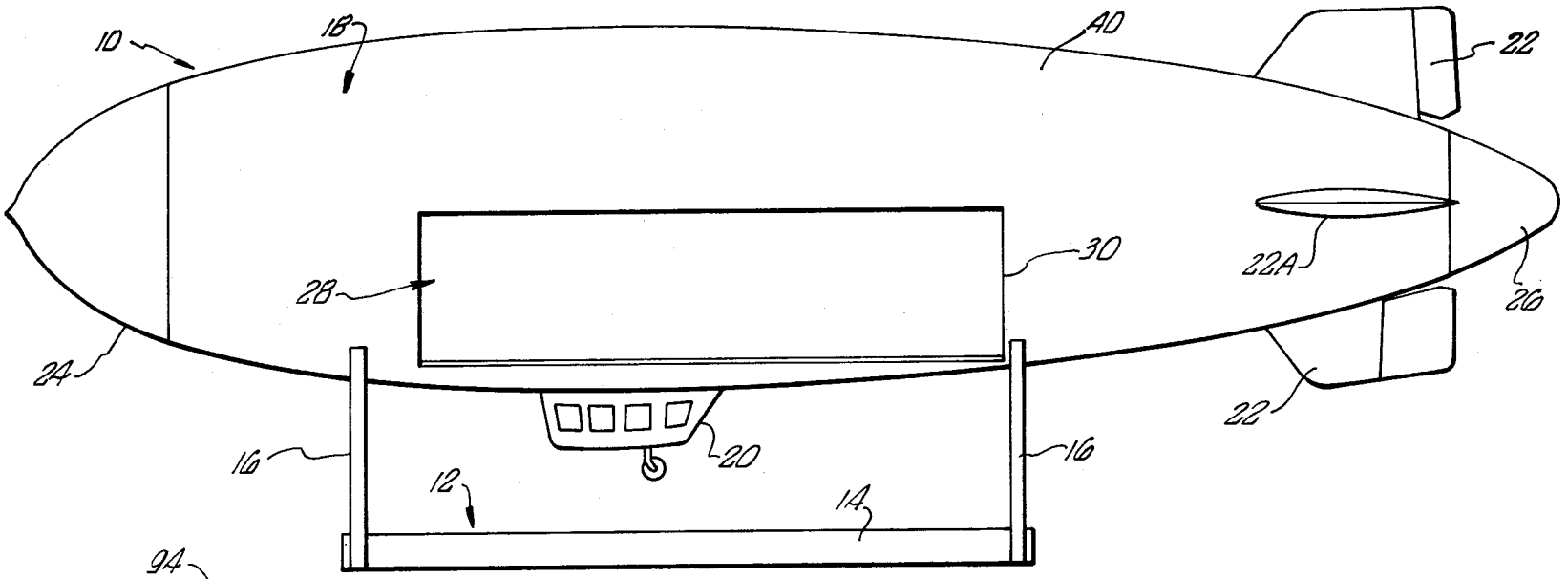
FIG. 1 is a side elevation of a miniaturized model of a blimp according to the present invention.

Referring now to FIG. 1 there is shown, in side elevation, a miniaturized model of a blimp 10 mounted in a display stand 12 having a base 14 and support arms 16. The blimp 10 is seen to be of conventional configuration, having a simulated gas containing fuselage 18 and a cabin 20. The blimp has fins 22 of which, in the preferred embodiment, one lateral fin 22A is movable so as to actuate the display, as will be described further hereinafter.

The model 10 has a nose cone 24 and a tail cone 26 to close the open-ended fuselage 18. Along a portion of the fuselage 18, an aperture 28 is formed, in which the message to be displayed appears from within the blimp. Disposed within the aperture 28 so as to close it is a masking screen 30 (see FIG. 5).

Figure 2:
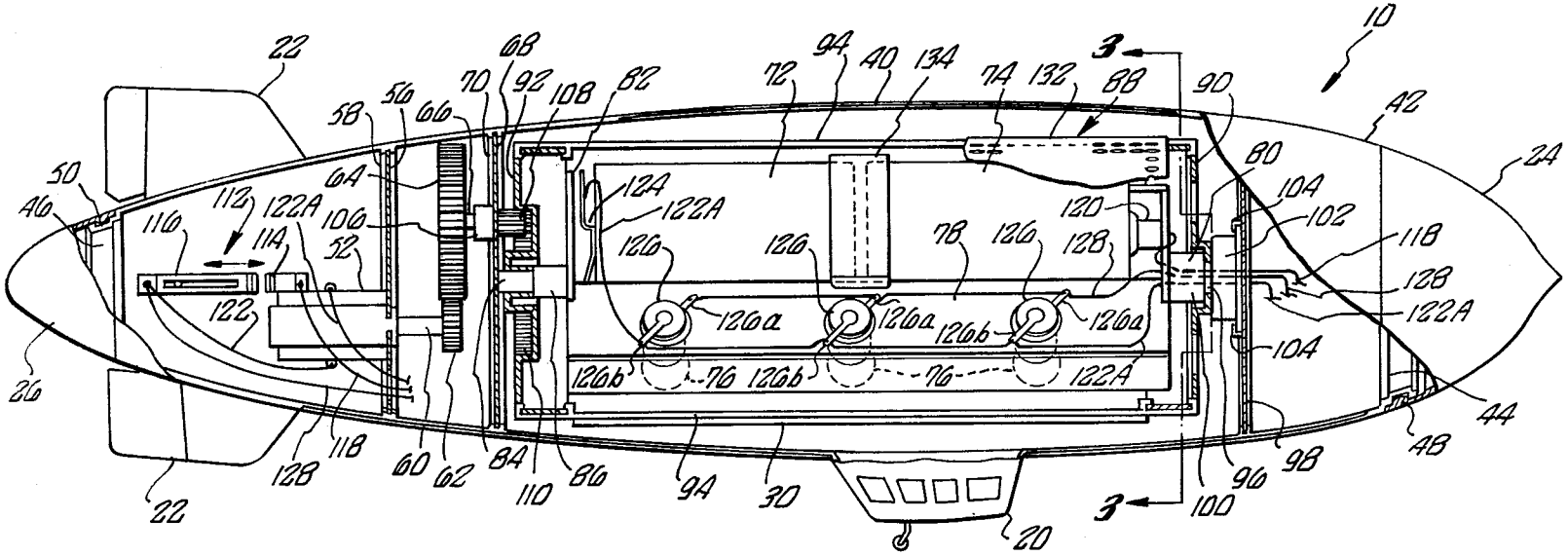
FIG. 2 is a side elevation, partially in section, of the opposite side of the miniaturized model shown in FIG. 1.

Referring now to FIG. 2, there is shown, partially in section, a side elevation of the blimp of FIG. 1, viewed from the opposite side. In FIG. 2, the fuselage 18 is seen to consist of an outer shall within which are the disposed various components utilized to provide the information display. The fuselage consists of two mating sections, a left fuselage section 40 and a right fuselage section 42. When placed together as is shown in FIG. 2, the left and right sections terminate in an annular recess 44 at the nose and an annular recess 46 at the tail. The nose cone 24 has an inwardly depending annular lip 48 which engages the annular recess 44 so as to clamp the left section 40 and right section 42 to the nose cone 24. Similarly, the tail cone 26 has an inwardly depending annular lip 50. The fuselage sections 40, 42, nose cone 24, and tail cone 26 are preferably made of polystyrene or the like, so as to have limited flexibility. Thus, the nose cone 24 and tail cone 26 can be press-fit over the fuselage sections 40, 42 so as to form a complete fuselage as a unitary body.

Disposed within the fuselage 18 is an electric drive motor 52 which is mounted on a motor support bulkhead 56 by any conventional means (not shown) such as a clamp which engages the bulkhead 56. The bulkhead 56 is mounted to the sections 40, 42 by being inserted into annular recesses formed in each of the sections 40, 42 in shoulders 58 formed circumferentially about the interior of the sections. The motor 52 has a drive shaft 60 to which is connected a drive reduction gear 62.

A main drive gear 64 engages the drive reduction gear 62 and is mounted on a main drive shaft 66 which is journalled through a drive support bulkhead 68. The drive support bulkhead 68 is mounted within the section 40, 42 shoulders 70 in the same manner as the motor support bulkhead 56.

Forward of the drive support bulkhead 68, the components utilized to illuminate the display are located. These components include a pair of batteries 72, 74 and three light bulbs 76. A battery and light holder 78 is fixed, at the forward end, to a forward battery and light holder retaining plate 80, and, at the aft end, to an aft battery and light holder retaining plate 82. The aft battery and light holder retaining plate 82 is journalled about an axle 84 formed on the bulkhead 68 at a hub 86 thereof.

A message carrying drum 88 encloses the retaining plates 80, 82, batteries 72, 74, battery and light holder 78, and lights 76. The drum 88 includes a drum forward end plate 90 and a drum aft end plate 92. The drum end plates 90, 92, are held together by a pair of drum locking strips 94 which are locked to the end plates as shown in FIG. 2 to form a rigid structure. The aft end plate 92 is journalled about the axle 84. A similar axle 96 extends from a forward bulkhead 98 so as to support the forward retaining plate 80. The forward end plate 90 is journalled about a hub 100 formed on the forward retainer plate 80. The axle 96 extends through the hub 100 and is locked thereto by any conventional means, such as keying, so as to prevent rotation of the forward retaining plate 80 while permitting the forward end plate 90 to rotate freely about the hub 100. The aft retaining plate 82 is similarly fixed to the axle 84. The battery and light holder 78 is attached to the forward retaining plate 80 and aft retaining plate 82. A retaining shim 102 is disposed between the forward bulkhead 98 and the forward retaining plate hub 100 so as to force the entire drum assembly aft toward the drive support bulkhead 68. The retaining shim 102 is held in place by a pair of guides 104 formed on the forward bulkhead 98 and engagement with an annular recess, not shown, on the axle 96.

As is seen in FIG. 2, the main drive shaft 66 is journalled through the drive support bulkhead 68 at a hub 106 and terminates in a drum drive gear 108. The drum drive gear 108 engages a gear surface 110 formed in a recessed outer portion of the aft end plate 92. Thus, rotation of the drive motor 52 will, through rotation of the reduction gear 62, main drive gear 64, and drum drive gear 108, cause the drum 88 to rotate within the blimp. Rotation of the drum 88 is initiated by actuating an electrical circuit shown schematically in FIG. 4, which includes, in addition to the batteries 72, 74, a switch 112 which is actuated by movement of the fin 22A. The switch 112 consists of a fixed terminal 114 which is attached to the fuselage section 40 by any appropriate means, such as a pin, and a movable terminal 116 which is attached to the movable fin 22A. The terminals 114, 116 are normally out of contact, and forward movement of the fin 22A moves the movable terminal 116 into physical contact with the fixed terminal 114. A first electrical lead 118 is connected to the fixed terminal 114 and extends through the bulkheads 56, 68, 98 to the forward portion of the blimp adjacent to the nose cone 24. The axle 96 and hub 100 have a passageway, not shown, formed therein through which the lead 118 passes and terminates at a forward battery terminal clip 120. A second electrical lead 122 is connected to the movable terminal 116, and one power input terminal on the motor 52. Connected to the other motor power input terminal is a lead 122A, which similarly extends through the bulkheads 56, 68 98, the axle 96 and hub 100, and is connected to an aft battery clip 124 and terminals 126B of light bulb holders 126 which hold the bulbs 76. The aft battery terminal clip 124 engages the base of the battery 72, is attached to the battery and light holder 78. A third electrical lead 128 is connected to the movable terminal 116 and extends forwardly past the bulkheads 98, 68, 56 and through the hub 100 and axle 96 to terminals 126A on the bulb holders 126.

Figure 4:
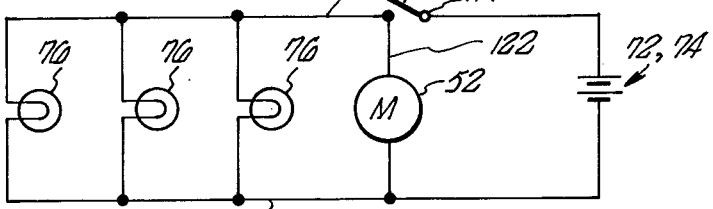
FIG. 4 is a schematic wiring diagram of the electrical circuit utilized to power the model.

As will be seen from FIG. 4, the switch 112 and batteries 72, 74 are connected in series and the bulb holders 126 and motor 52 are connected in parallel across the circuit formed by the batteries 72, 74 and switch 112. Thus, when the switch 112 is closed, so that electrical contact is made between the switch terminals 114, 116, electrical power is applied to the bulbs 76, causing them to light and to the motor 52, energizing it so as to rotate the drum 88.

Referring again to FIG. 2, in order to provide a message which may be viewed through the aperture 28, an information screen 132 is fixed about the drum 88 so as to form the outer surface thereof. The message is carried on the screen in the preferred embodiment by utilizing a pre-selected pattern of transparent circles or dots on the screen. The dots are formed on an opaque background, in the preferred embodiment, and the message is formed by utilizing a screen which contains an array of transparent dots, such as the array of FIG. 5, and darkening selected dots to leave a remaining transparent portion, which corresponds to the information to be displayed in the form of transparent dots. If desired, these transparent dots can then be colored to provide other than a light on dark background display. Alternatively, the darkened portion can correspond to the information to be displayed on a light background. After the screen has been processed to provide for the desired pre-selected pattern of transparency corresponding to the message to be displayed, the screen is mounted on the drum by any conventional means, such as adhesives or mechanical clips. Ordinarily, the drum is not so rotatable because of the engagement of the drum drive gear 108 and gear surface 110. In order to facilitate mounting of the screen on the drum, it is desirable for the drum to be freely rotatable. In order to provide for such free rotation during the screen mounting operation, the retaining shim 102 is removed, so that the drum may be moved forward to disengage the gear 108 from the gear surface 110. After mounting the screen 132, the drum is moved aft so as to reengage the gear 108 and gear surface 110, and the retaining shim reinserted in the disposition shown in FIG. 2 to lock the gear 108 in engagement with the gear surface 110.

Figure 3:
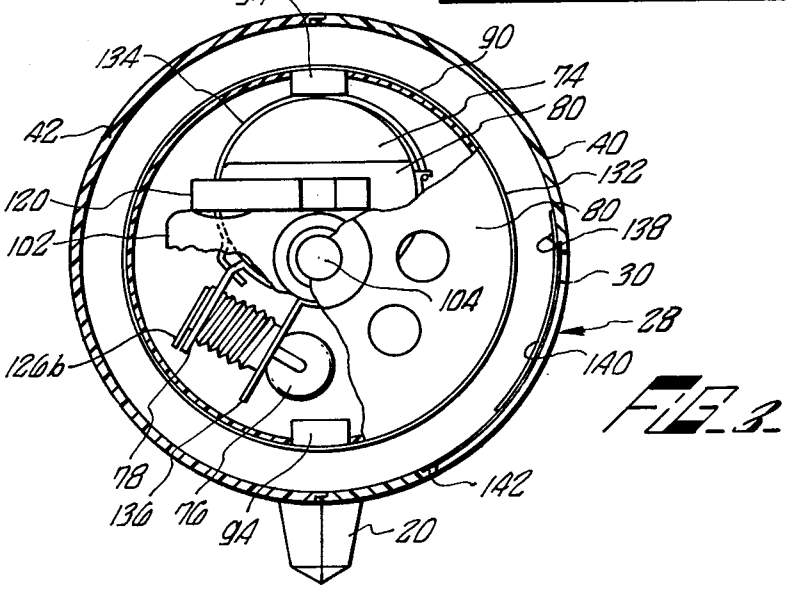
FIG. 3 is a view, in section, taken along lines 3—3 of FIG. 1.

Referring now to FIG. 3, there is shown, in crosssection, a view taken along lines 3—3 of FIG. 2 to better illustrate the disposition of the various blimp components. A battery clamp 134, also shown in FIG. 2, holds the batteries 74, 72 to the battery and light holder 78. For purposes of clarity the wiring 122, 118, 128 is not shown in FIG. 3. Energization of the electrical system through closing the switch 112, in addition to producing illumination from the bulbs 76, causes the drum 88, which bears the information screen 132, to rotate so that progressive portions of the screen 132 pass adjacent the masking screen 30 and are illuminated by means of the bulbs 76. The masking screen 30 is held in place by any conventional means. As illustrated in FIG. 3, a pin 138 is used, to which is attached a leaf-type fastener 140. The fastener 140 overlaps a portion of the masking screen 30 which extends longitudinally beyond the aperture 28 so as to press a portion of the screen 30, which cannot be viewed through the aperture 28, against the left fuselage section 40, thereby holding the screen in place. Preferably, as is shown in FIG. 3, the left fuselage section 40 has a complementary recessed portion 142 formed therein to receive the screen 30, thereby facilitating the holding in place of the screen 30.

Figure 5:
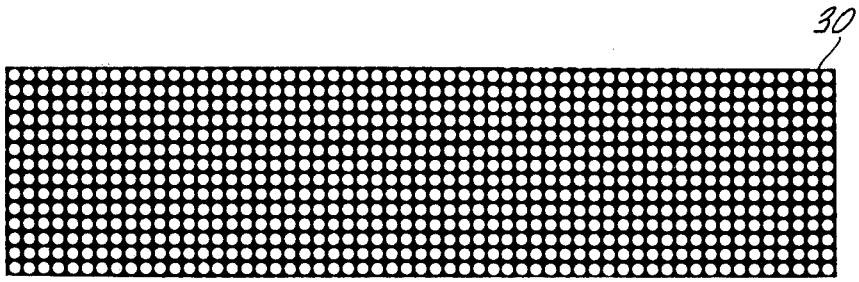
FIG. 5 is a view of a masking screen for use in the present invention.
Figure 6:
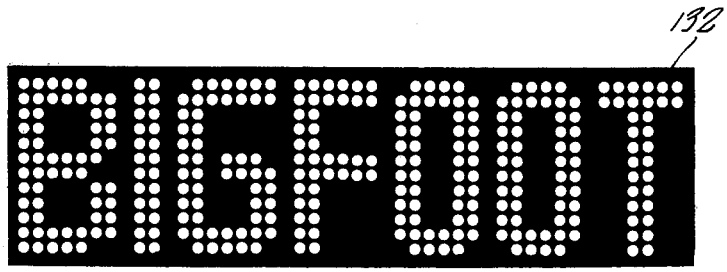
FIG. 6 is a view of a portion of an information screen for use in the present invention.

FIG. 5 is a view of the preferred embodiment of screen pattern of transparency utilized in the masking screen 30. As is seen in FIG. 5, the pattern consists of a rectangular array of small transparent circles or dots. The information screen 132, a portion of which is shown in FIG. 6, also utilizes this same general pattern of transparency, in the preferred embodiment. The overall background of the screen is one of opaqueness with selective portions of the information carrying screen having less opacity so as to contain the information to be displayed. Alternatively, the information display screen could have the same general transparency pattern as the masking screen 30, with opacity being utilized to set out the information to be displayed.

Figure 7A:
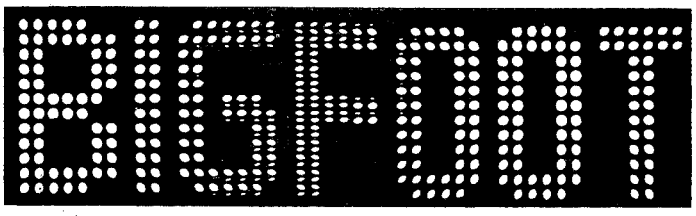
FIG. 7, parts (*a*) through (*c*) taken together, illustrates the operation of the information display according to the present invention.
Figure 7B:
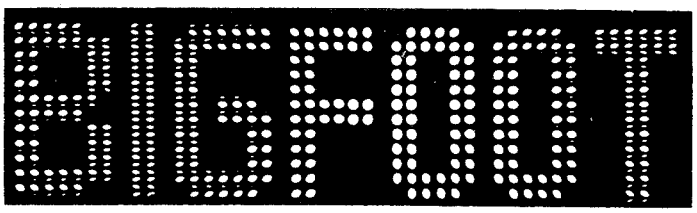
Figure 7C:
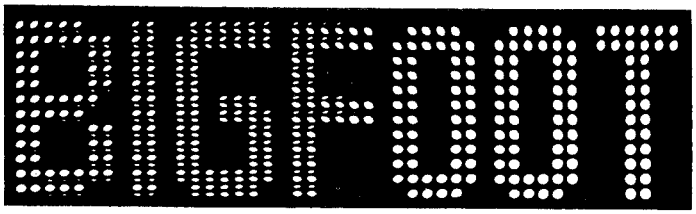

FIG. 7, parts (*a*) through (*c*) taken together, illustrates the display of a message to simulate sequential illumination of the letters providing the information in which a screen 132 is utilized with a masking screen 30. As is shown in FIG. 7(*a*), the word BIGFOOT carried by the information screen 132 is partially obscured by the masking screen 30. The letter B is unobscured, by reason of the coincidence of the dots forming this letter and the corresponding dots in the array of dots in the masking screen 30. However, the letter F is almost entirely obscured. Depending upon the relative size of the dots and their spacing one from another, a masking screen 30 and information screen 132 can be utilized which would completely obscure the letter F. Such could be accomplished by decreasing the size of the dots or increasing the spacing there between. As the information screen 132 rotates, so as to move the word BIGFOOT past the masking screen 30, the dots forming the letter B become misaligned with respect to the dot array of the masking screen 30, thereby decreasing the illumination which may pass through these two sets of dots to be viewed through the aperture 28. Thus, in FIG. 7(*b*), the letter B has lost much of its itensity. Conversly, the letters F and O, which were obscured in FIG. 7(*a*), now have their dot array in general alignment with the dots of the masking screen 30, and so more light can pass from the bulbs 76 through these two sets of dots into aperture 28 to be viewed by the viewer. Finally, in FIG. 7(*c*), the relative alignment of the dots between the masking screen 30 and information screen 132 has further changed, so that the dots forming the letter T are generally aligned with the dots of the masking screen. Thus, the intensity of illumination of the message, in this case the word BIGFOOT moves perpendicularly to the direction of rotation of the drum 88 and parallel to the axis of rotation of the drum.

In operating the blimp of the present invention, the blimp may either be removed from the stand 12 or left being supported by it. The fin 22A is moved forwardly, thereby closing the switch 112 so as to apply electrical power to the batteries 72, 74 through the leads 122, 130 to the bulbs 76 and through the leads 122, 128 to the motor 52. The bulbs therefore light up, casting light through the information screen 132 and on to the surface of the masking screen 30 in a pattern formed by the transparent portion of the information screen 132. Those portions of the illuminated pattern falling on the masking screen 30 which fall upon transparent portions of the masking screen 30 then permit the passage of light outwardly through the aperture 28 to be viewed externally of the blimp by a viewer. Portions of the illumination pattern which fall on the opaque portion of the masking screen 30 are not seen by the viewer.

Rotation of the drum 88 by the motor 52 through the gears 62, 64, 108 and the gearing surface 110 changes the alignment of the illuminated pattern falling on the masking screen 30 and the transparent portions of the masking screen, thereby creating the illusion of lateral movement of the message. This lateral movement takes the appearance of a wave or a series of waves, depending upon the relative skewing between the patterns of the masking screen and information screen. If a disposition of these screens is utilized such that the arrays are laterally aligned, the rotation of the drum 88 will produce a simple illusion of vertical movement of the message in waves rather than the combined lateral and vertical movement produced by skewing the alignments. The alignments may be skewed by between ½° and 3° to obtain the desired extent of combined lateral and vertical movement.

The information contained upon the information screen 132 is obviously not limited to a single word. A series of words may be utilized so as to appear in sequence at the aperture 30. Thus, FIGS. 5 through 7 illustrate, for purposes of explanation only, how a single word may be displayed and such explanation is not by way of limitation, as normally a series of words, pictures, or other information will be utilized.

After the drum has rotated so as to produce one or more viewings of the message, the fin 22A is moved aft so as to open the switch 112 and de-energize the motor 52 and bulbs 76. Thus, the electrical circuitry shown in FIG. 4 provides a selectively actuable system for illuminating the information to be displayed and displaying the information. The information itself is selectively determined by the user by means of various information screens 132 which, in the preferred embodiment, consist of arrays of transparent or translucent dots which have been selectively made of greater opacity to provide a dark background on which the message appears as a presentation of light through the remaining transparent or translucent dots. These latter dots may themselves be colored or otherwise processed to provide displays which vary from a simple black and white display. As further variant, the light bulb 76 may be colored rather than clear, so that what would otherwise by a black and white display is a display of black and the color produced by the bulbs. Obviously, combinations of colored bulbs and colored displays can also be used.

While a particular embodiment described is an embodiment which utilizes a model blimp as an enclosure for the display device, the scope of the invention is obviously not so limited. In its broadest aspect the invention comprehends a masking screen disposed in an aperture in a surface, which, of course, may be nothing more than a panel or a side of an enclosure. The panel or enclosure need not be curved, but may be flat. The information screen need not be formed in a drum configuration, but may be in the form of rolls or endless belts which pass adjacent a flat or curved masking screen, as desired, with respect to the particular application of the present invention. Further, while in the particular embodiment shown, an electric drive motor has been utilized, any appropriate drive means, such as, for example, a wind-up motor, can be utilized if desired. Obviously, such drive means may be utilized in applications other than in the particular blimp application described. For example, a particular application, corresponding rather closely to the blimp application, would be the utilization of an enclosure in the form of a cylinder with a cylindrical information screen disposed therewithin driven by a wind-up motor which may be wound externally of the enclosure.

The invention claimed is:

1. In a model of a blimp the combination of:

a hollow outer shell for the blimp;

an aperture formed in the outer shell for display of information;

a masking screen having a preselected pattern of transparency;

an information screen having an exterior surface and an interior surface and having the same general pattern of transparency as the masking screen;

means for increasing the opacity of selected otherwise transparent portions of the information screen to the blimp with respect to the aperture so that the masking screen fills the aperture;

means for mounting the information screen in a generally longitudinal disposition within the blimp, on a frame so as to form a drum, an so positioned that at least a portion of the screen is adjacent the masking screen whereby the information screen is disposed interiorly of the masking screen and can be viewed through the aperture and masking screen;

said drum including a pair of end plates at opposite ends thereof, said mounting means for the information screen including a pair of bulkheads connected to the outer shell and spaced so that the drum is disposed therebetween, and complementary hub and axle means connected between each of the bulkheads and the adjacent drum end plate so as to rotatably connect the drum to the bulkheads, means including an electric drive motor mounted within the blimp, connected to the cylinder frame and operable when actuated to rotate the drum and thereby selectively initiating relative movement between the masking screen and the information screen; and selectively actuable information screen and illuminating means connected to the blimp and operable, when actuated, to cause the illumination of the interior surface of the information screen.

2. In an assemblable multi-part model blimp display kit, the combination including a model blimp and an information display associated therewith, comprising:

a hollow main body formed of matable sections adapted for intercoacting connectible assembly one to another;

an information displaying aperture formed in a side of said body;

a masking screen mountable in said aperture and having a preselected pattern of transparency thereon;

support members mountable within and supportable by the assembled body in a longitudinally spaced disposition therein;

a hollow frame member insertable in said body and movably carried by said spaced suuports;

an information carrying screen selectively mountable on said hollow frame member, the information on said screen being of a nature similar to the general pattern of transparency of said masking screen;

said information screen being positioned on and by said frame so as to dispose a portion thereof adjacent said masking screen for coaction therewith;

drive means mountable and supportable within said body for so moving said hollow frame member as to move said information screen relative to said masking screen;

illumination means mountable within the hollow frame adapted when actuated to cause illumination from within the interior thereof to pass through transparent portions of the information screen and fall on the masking screen, the relative movement between the information screen and masking screen, in conjuction with the illumination from within, resulting in a changeable visual information display through said information displaying aperture.

3. In an assemblable multi-part model blimp display kit, as claimed in claim 2, said hollow frame member with said information carrying screen mounted thereon being substantially in the form of a cylindrical drum to thereby appropriately coact with the main body having a substantially cylindrical normal, blimp simulated configuration.

4. In an assemblable mulit-part model blimp display kit, as claimed in claim 2, wherein a source of electrical power, an electric drive motor, and an actuating electric circuit therefore and for the illuminating means, are operably mountable within the body for appropriate component actuation.

5. In an assemblable multi-part model blimp display kit, s claimed in claim 2, the masking screen being so disposed relative to the information screen that the pattern of transparency of the masking screen is skewed from about ½° to about 3° relative to the pattern of transparency of the information screen.

6. In an assemblable multi-part model blimp display kit, as claimed in claim 2, and said drive means including an electric motor, and terminating in a gear, and complementary gear means connected to the frame member for the information carrying screen so that activation of the drive motor causes rotation of the frame and information screen within the body adjacent the masking screen.

* * * * *

UNITED STATES PATENT OFFICE

CERTIFICATE OF CORRECTION

Patent No. 4,034,491 Dated July 12, 1977

Inventor(s) DAVID R. FISHER, DON C. WILLIS, FREDERICK W. JOHN, JAMES R. POWERS, JAMES M. DOYLE, LONNIE D. COOPER, DENNIS C. RICH It is certified that error appears in the above-identified patent and that said Letters Patent are hereby corrected as shown below:

| | |
|---|---|
| Col. 2, line 53 | "tion" should read --tions-- |
| Col. 5, line 31 | "itensity" should read --intensity-- |
| Col. 7, line 14 | "an" should read --and-- |
| Col. 8, line 2 | "suuports" should read --supports-- |
| Col. 8, line 20 | "conjuction" should read --conjunction-- |
| Col. 8, line 31 | "mulit-part" should read --multi-part-- |
| Col. 8, line 38 | "s" should read --as-- |

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*